US005406354A

United States Patent [19]

Taki et al.

[11] Patent Number: 5,406,354

[45] Date of Patent: Apr. 11, 1995

[54] IMAGE FORMING APPARATUS WITH A SHEET WRAPPING DETECTION APPARATUS

[75] Inventors: Kenji Taki; Chiharu Kobayashi; Takao Kurohata, all of Tokyo, Japan

[73] Assignee: Konica Corporation, Tokyo, Japan

[21] Appl. No.: 142,174

[22] Filed: Oct. 25, 1993

[30] Foreign Application Priority Data

Nov. 25, 1992 [JP] Japan ..... 4-315105

[51] Int. Cl.[6] ..... G03G 15/00

[52] U.S. Cl. ..... 355/207; 355/206

[58] Field of Search ..... 355/203, 205, 206, 207, 355/315; 250/561

[56] References Cited

U.S. PATENT DOCUMENTS

| | | | |
|---|---|---|---|
| 3,878,398 | 4/1975 | Nellis | 250/561 |
| 4,423,949 | 1/1984 | Cormier | 355/206 |
| 4,505,572 | 3/1985 | Ashida et al. | 355/205 X |

*Primary Examiner*—Joan H. Pendegrass
*Attorney, Agent, or Firm*—Frishauf, Holtz, Goodman & Woodward

[57] ABSTRACT

An image forming machine, such as a copier or a printer, for forming a toner image on a recording sheet includes a developer for forming a toner image on a photoreceptor, the photoreceptor holding the toner image on its surface; a transfer device for transferring the toner image onto the recording sheet; a light emitting device for irradiating a light beam onto the surface of the photoreceptor; a light receive for detecting a reflection of the light beam from the surface of the photoreceptor, and for generating a variable detection signal according to an amount of the reflection of the light beam; a first comparing circuit for comparing a value of the variable detection signal with a first predetermined threshold value, and for generating a first comparison signal; a first judgment circuit for determining whether or not a sheet wrapping jam of the recording sheet on the photoreceptor occurs according to the first comparison signal; a first memory for storing the value of the variable detection signal when the first judgment circuit determines that the sheet wrapping jam occurs; a first calculation circuit for calculating a second threshold value according to the value of the variable detection signal stored in the first memory; a second comparing circuit for comparing the value of the variable detection signal with the second threshold value, and for generating a second comparison signal; and a second judgment circuit for determining whether or not a sheet wrapping jam of the recording sheet on the photoreceptor is solved according to the second comparison signal.

9 Claims, 11 Drawing Sheets

IMAGE FORMING APPARATUS WITH A SHEET WRAPPING DETECTION APPARATUS

BACKGROUND OF THE INVENTION

In an image forming apparatus such as an electrophotographic copier, after the circumferential surface of a photoreceptor drum has been uniformly charged by a charging unit, image exposure is carried out on the circumferential surface of the photoreceptor drum so as to electrostatically form a latent image. This latent image is developed by a developing unit to be visualized. In this way, a toner image is formed. The toner image formed on the circumferential surface of the photoreceptor drum is transferred by a physical means onto a recording paper conveyed in timed relation with the formation of the toner image. The recording paper onto which the toner image has been transferred is separated from the photoreceptor drum surface, and conveyed to a fixing unit so that the toner image is fixed. After that, the recording paper is discharged outside of the image forming apparatus.

In the process of transfer in which the toner image formed on the circumferential surface of the photoreceptor drum is transferred onto a recording sheet, the toner image is charged so that it can be a polarity reverse to that of the toner image by a transfer unit that discharges behind the recording paper. By the action of the charge given by the transfer unit, the toner image is transferred onto the recording sheet. After that, a high AC voltage is impressed upon the recording sheet so that the recording sheet is neutralized and separated from the photoreceptor drum surface. However, it is difficult to positively ensure the transfer properties of the toner image and the separation properties of the recording sheet. Especially when the diameter of the photoreceptor drum is large, it becomes difficult to separate the recording sheet from the photoreceptor drum. When the recording sheet adheres onto the photoreceptor drum surface in the manner described above, paper jam tends to occur.

In order to take measures against the occurrence of jam, a sheet wrapping detection apparatus is conventionally provided, which detects whether or not a recording sheet has been separated from the surface of a photoreceptor drum.

With reference to FIG. 4, a conventional example of the aforesaid sheet wrapping detection apparatus will be explained as follows.

In FIG. 4, a reflection type photosensor 30 for detecting sheet wrapping is provided in the periphery of a photoreceptor drum 10 in the downstream of a transfer unit with respect to the direction of rotation of the photoreceptor drum 10. As illustrated in FIG. 4, this photosensor 30 includes: a light emitting diode 31, which is a light emitting element, being provided so that it can irradiate a beam of light in a direction perpendicular to the surface of the photoreceptor drum 10; and a phototransistor 32, which is a light receiving element, being provided so that it receives a beam of light reflected on the surface of the photoreceptor drum 10 after the beam of light has been emitted from the light emitting diode 31, wherein the reflection angle is $\theta$ on the photoreceptor drum surface. The photosensor 30 is controlled by a control unit 40 having a microcomputer.

The light emitting diode 31 emits light in accordance with a light emitting signal outputted from the control unit 40 in a predetermined timed relation, and the beam of emitted light is perpendicularly irradiated on the surface of the photoreceptor drum 10. Reflected light is received by the phototransistor 32. In the case of a sheet of paper on which a large amount of light is irregularly reflected, an amount of photoreception of the phototransistor 32 is large. On the other hand, in the case of the photoreceptor 10 on which a large amount of light is regularly reflected and a small amount of light is irregularly reflected, an amount of photoreception of the phototransistor 32 is small. In some cases, developed toner is left on the surface of the photoreceptor drum 10. In this case, a beam of light reflected on the residual toner is received by the phototransistor 32, and the level of received light becomes approximately the same as that of received light in the case of photoreceptor drum 10.

Accordingly, the operation is conducted in the following manner:

As shown in FIG. 5, the photoreception level of the photoreceptor drum and that of the toner are expressed by one-dotted chain lines, and the photoreception level of a recording sheet is expressed by a solid line. According to the difference between both photoreception levels, a threshold value S is set between both photoreception levels. This threshold value S and a photoreception output of the phototransistor 32 are compared by the control unit 40. In the case where the photoreception level is lower than the threshold value S, it is judged that the beam of light is reflected on the photoreceptor drum 10 or toner. Therefore, it is judged that no recording sheet is wrapped around the photoreceptor drum 10. In the case where the photoreception level is higher than the threshold value S, it is judged that the beam of light is reflected on a sheet of paper. Therefore, it is judged that a recording sheet is wrapped around the photoreceptor drum 10, and the apparatus is automatically stopped. In this connection, as illustrated by solid lines in FIG. 5, the photoreception levels of the photoreceptor drum 10, of toner, and of the recording sheet are deviated in accordance with the apparatus.

In the case where the image forming apparatus was stopped according to the result of judgment that a recording sheet had wrapped around the photoreceptor drum, it is necessary to check the release of the wrapped recording sheet before the start of a warm-up operation of the apparatus. Conventionally, in order to check the release of the wrapped recording paper, a comparison is made between the threshold value used when the apparatus was stopped, and the output value outputted from the photosensor 30 when the apparatus is restarted.

However, as shown in FIGS. 6 and 7, the conventional photosensor 30 is disposed in the apparatus so that a beam of light L emitted from the light emitting diode 31 meets at right angles with the axis A of the photoreceptor drum 10.

In this case, the circumferential surface of the photoreceptor drum 10 is cleaned by a blade to remove the residual toner from the surface after a toner image has been transferred on to a recording sheet. In the process of cleaning, the circumferential surface of the photoreceptor drum 10 is slightly damaged, that is, minute scratches are caused on the surface in the circumferential direction. Also, when the photoreceptor drum is manufactured, the drum surface is subjected to brushing in the circumferential direction. Therefore, minute scratches are caused on the surface in some cases. Due the scratches, beams of light are irregularly reflected on the surface of the photoreceptor drum 10. An amount of light irregularly reflected in the axial direction of the drum is larger than that irregularly reflected in the circumferential direction.

As a result of the foregoing, in the conventional photosensor arrangement, the photoreception level of the photosensor 30 is greatly deviated due to the reflected light on the photoreceptor drum 10 as shown in FIG. 5. As an amount of irregularly reflected light is increased, a difference between the photoreception level with respect to a recording sheet and that with respect to a photoreceptor drum becomes small. Therefore, it is difficult to appropriately set a threshold value so as to discriminate both photoreception levels, which is a problem encountered in the conventional photosensor arrangement.

Also, the output values of the individual photosensors 30 are deviated. Further, the output values are deviated when the photosensors 30 are stained with toner, or the environmental temperature is changed. Further, an amount of photoreception of the photosensor 30 varies according to the type of recording sheets. Due to the foregoing, the following problem may be encountered in the conventional device: In the conventional device, the threshold value is fixed. Therefore, erroneous detection of sheet wrapping tends to occur.

Unlike monochromatic printing in which black toner, the photoreception level of which is greatly different from that of a recording sheet, is used, in the case of color printing in which a plurality of toners such as yellow toner are used, the photoreception level of the photosensor 30 with respect to yellow toner is close to that with respect to recording sheets. In this case, there is a possibility of erroneous detection.

Furthermore, the characteristics of the photosensor 30 are varied when the environmental temperature is changed. Therefore, the characteristics of the photosensor 30 at the time of detection of release of sheet wrapping is different from those at the time of detection of sheet wrapping. In addition to that, the threshold value is fixed. For that reason, an erroneous detection is caused in the following manner:

Although a wrapped recording sheet has been released, the result of detection is that the recording sheet still wraps around the photoreceptor drum.

Especially, there is a high possibility of the erroneous detection in the case where a toner such as yellow toner, the photoreception level of the photosensor 30 of which is close to that of recording sheet, is deposited on the photoreceptor drum surface. In the erroneous detection, although a wrapped recording sheet has been released, the result of detection is that the recording sheet still wraps around the photoreceptor drum. There is also a possibility that while the recording sheet still wraps around the photoreceptor, the result of detection is that the recording sheet is released.

In view of the aforesaid problems, the present invention has been achieved. It is an object of the present invention to provide a sheet wrapping detection apparatus for use in an image forming apparatus in which the arrangement of the optical detection means is changed, so that a difference between the photoreception level with respect to recording sheets and that with respect to the photoreceptor drum can be made large, and the deviation of the photoreception level of the photoreceptor drum is small and the threshold value can be easily set, and as a result the occurrence of erroneous detection can be reduced.

In view of the aforesaid problems, the present invention has been achieved. It is an object of the present invention to provide a sheet wrapping detection apparatus for use in an image forming apparatus capable of positively detecting a sheet wrapping condition without being affected by the deviation of photoreception levels caused by the change of temperature and the stain of the optical detection means.

In view of the aforesaid problems, the present invention has been achieved. It is an object of the present invention to provide a sheet wrapping detection apparatus for use in an image forming apparatus in which the release of sheet wrapping can be reliably performed.

SUMMARY OF THE INVENTION

In order to reduce the deviation of the photoreception level of a light receiving element, a sheet wrapping detection apparatus of the present invention comprises an optical detection means in which a light emitting element and a light receiving element of an optical detection means are disposed in an axial direction of a photoreceptor drum, wherein a beam of light emitted from the light emitting element is irradiated on a surface perpendicular to an axis of the photoreceptor drum in a direction not crossing the axis.

In the aforesaid construction, in the case of a photoreceptor drum, on the surface of which minute scratches are formed in the circumferential direction by a brush or a blade in the process of cleaning, an amount of irregularly reflected light in the circumferential direction is smaller than that in the axial direction, that is, the longitudinal direction of the photoreceptor drum. In this case, an amount of reflected light incident on the light receiving element disposed along the axis of the photoreceptor drum is compared in the following two cases. One is a case of the conventional apparatus in which the optical detection means is constructed so that a beam of light emitted by the light emitting element meets right angles with the axis of the photoreceptor drum. The other is a case of the apparatus of the present invention in which a beam of light emitted from the light emitting element is irradiated on a surface perpendicular to the axis of the photoreceptor drum in a direction not crossing the axis. An amount of reflected light incident on the light receiving element in the latter case is smaller than that in the former case. On the other hand, in the case of recording sheets, a beam of light is irregularly reflected equally in all directions. Therefore, a constant amount of reflected light is incident on the light receiving element irrespective of the irradiating direction of the light emitting element.

Consequently, the photoreception level of the light reflected on recording sheets is hardly changed. On the other hand, the photoreception level of the light reflected on the photoreceptor drum surface is lowered. Therefore, a difference between both photoreception levels can be increased. Accordingly, it is easy to select an appropriate threshold value. As a result, the frequency of occurrence of erroneous detection of sheet wrapping can be greatly reduced.

In order to prevent the erroneous detection of sheet wrapping caused by the change in the characteristics of the photoreceptor and photosensor, the apparatus of the present invention is constructed in the following manner:

In a proportional constant calculation means illustrated in FIG. 2, in accordance with the photoreception output value measured by an optical detection means under the condition that the photoreceptor surface is solidly coated with toner, and also in accordance with the photoreception output value of the photoreceptor surface itself measured by the optical detection means, a proportional constant of the photoreception output value with respect to the recording sheet and the photoreceptor surface is calculated. A proportional constant calculated by the proportional constant calculation means is stored by a proportional constant memory means. Each time a sheet wrapping detection operation is started, a photoreception output value on the photoreceptor surface measured by the optical detection means is multiplied by a proportional constant stored in the proportional constant memory means, and a threshold value is calculated by a threshold value calculation means. An output value of the optical detection means based on a beam of light irradiated on the photoreceptor surface by the optical detection means at the time of sheet wrapping detection, and the threshold value calculated by the threshold value calculation means are compared. According to the result of the above comparison, whether or not a recording sheet wraps around the photoreceptor is judged by a judgment means.

Each time the photoreceptor is replaced, the calculation of the proportional constant is carried out, so that the stored value of the proportional constant is renewed. In this case, before the photoreceptor is replaced, the proportional constant is renewed in accordance with the frequency of the use of the photoreceptor.

In the case where the release of the previous sheet wrapping has not been checked yet at the start of sheet wrapping detection, the optical detection means output value in the case of the judgment of the previous sheet wrapping is multiplied by a predetermined correction factor so that a threshold value is calculated.

During the process of sheet wrapping detection, the photoreceptor surface is measured once or a plurality of times. In the case where all the measured values are out of a predetermined range, it is judged that an abnormality has occurred, and the threshold value is fixed to be a previously determined fixed value.

In the case where the calculated proportional constant is out of the predetermined range, it is judged that an abnormality has occurred, and the operation of the apparatus is stopped.

In the case where the output value of the optical detection means is out of the predetermined range when the light emitting element is emitting light or when the light emitting element is not emitting light, it is judged that an abnormality has occurred, and the operation of sheet wrapping detection is stopped.

Each time a printing operation is conducted, the threshold value for judgment of sheet wrapping is variably set. Accordingly, even when the environmental temperatures of the photoreceptor and the optical detection means are changed, or even when the optical detection means is smudged with toner, the threshold value can be changed in accordance with the variation of the photoreception level. Therefore, erroneous detection of sheet wrapping can be prevented.

When the photoreceptor has been replaced or the frequency of the use of the photoreceptor is increased, the calculation of the proportional constant is carried out again so that the stored value in the memory means is renewed. Therefore, even when the photoreception level is changed due to the deterioration of the photoreceptor as the time passes, or even when the reflection characteristics of individual photoreceptors are different, there is no possibility of the occurrence of erroneous detection.

In the case where the release of the previous sheet wrapping has not been checked yet at the start of sheet wrapping detection, it is not possible to discriminate whether the optical detection means output has been sent from a recording sheet or the photoreceptor surface. In this case, the optical detection means output value in the case of the judgment of the previous sheet wrapping is multiplied by a predetermined correction factor so that a threshold value is calculated.

During the process of sheet wrapping detection, the photoreceptor surface is measured once or a plurality of times, and in the case where all the measured values are out of the range, it is judged that an abnormality has occurred. Also, when the proportional constant calculated by the proportional constant calculation means is out of a predetermined range, it is judged that an abnormality has occurred. Also, when the output value of the optical detection means is out of a predetermined range when the light emitting element is emitting light or when the light emitting element is not emitting light, it is judged that an abnormality has occurred, and the threshold value is fixed at a predetermined fixed value, or the apparatus is stopped, or the sheet wrapping detection operation is stopped. In this way, malfunction of the sheet wrapping detection apparatus can be prevented.

In order to prevent erroneous detection when it is detected whether or not a recording sheet wraps around the photoreceptor drum in the sheet wrapping release confirmation operation, the apparatus of the present invention includes a sheet wrapping release judgment means constructed in the following manner as shown in FIG. 1:

An output value of the optical detection means is stored in the memory means in the case where it has been judged that a sheet wraps around the photoreceptor drum. After it has been judged by the sheet wrapping judgment means that the recording sheet wraps around the photoreceptor drum, a threshold value to confirm the release of sheet wrapping is calculated by the calculation means in accordance with the stored output value of the optical detection means. Whether or not the sheet wrapping has been released is judged when a comparison is made between a threshold value calculated by the calculation means at the time of sheet wrapping release detection after the judgment of sheet wrapping, and an output value provided by the optical detection means.

In the calculation means, the output value of the optical detection means stored in the memory means is subjected to temperature correction, and the calculation means calculates a threshold value.

In the case where the output value of the optical detection means is out of a predetermined range when the light emitting element is emitting light or when the light emitting element is not emitting light, it is judged that an abnormality has occurred, and the judgment operation is stopped.

In the aforesaid construction, whether or not the sheet wrapping has been released is judged when a comparison is made between a threshold value calculated by the calculation means at the time of sheet wrapping release detection after the judgment of sheet wrapping, and an output value provided by the optical detection means.

As described above, when a threshold value used for a sheet wrapping release confirmation operation conducted later is set in accordance with the output value of the optical detection means provided in the detection of sheet wrapping, it is not necessary to give consideration to the toner stain of the optical detection means and the output deviation caused by the difference between the individual photoreceptor drums. Therefore, the threshold value can be set close to the output value at the time of recording sheet detection. Accordingly, the reliability of confirmation of the sheet wrapping release can be improved.

The output value of the optical detection means stored in the memory means is provided under the condition that the apparatus is in operation so that the temperature of the optical detection means is raised. However, the confirming operation of the release of sheet wrapping is conducted before a warming-up operation in which the temperature is low. Therefore, when the output of the optical detection means stored in the memory means is subjected to temperature correction, the reliability of confirmation of the release of sheet wrapping can be improved.

In the case where the output value of the optical detection means is out of a predetermined range when the light emitting element is emitting light or when the light emitting element is not emitting light, it is judged that an abnormality has occurred, and the confirmation operation of the release of sheet wrapping is stopped. In this way, malfunction can be prevented in the process of confirmation of the release of sheet wrapping.

DETAILED DESCRIPTION OF THE INVENTION

With reference to the accompanying drawings, an example of the present invention will be explained as follows.

Figure 1:
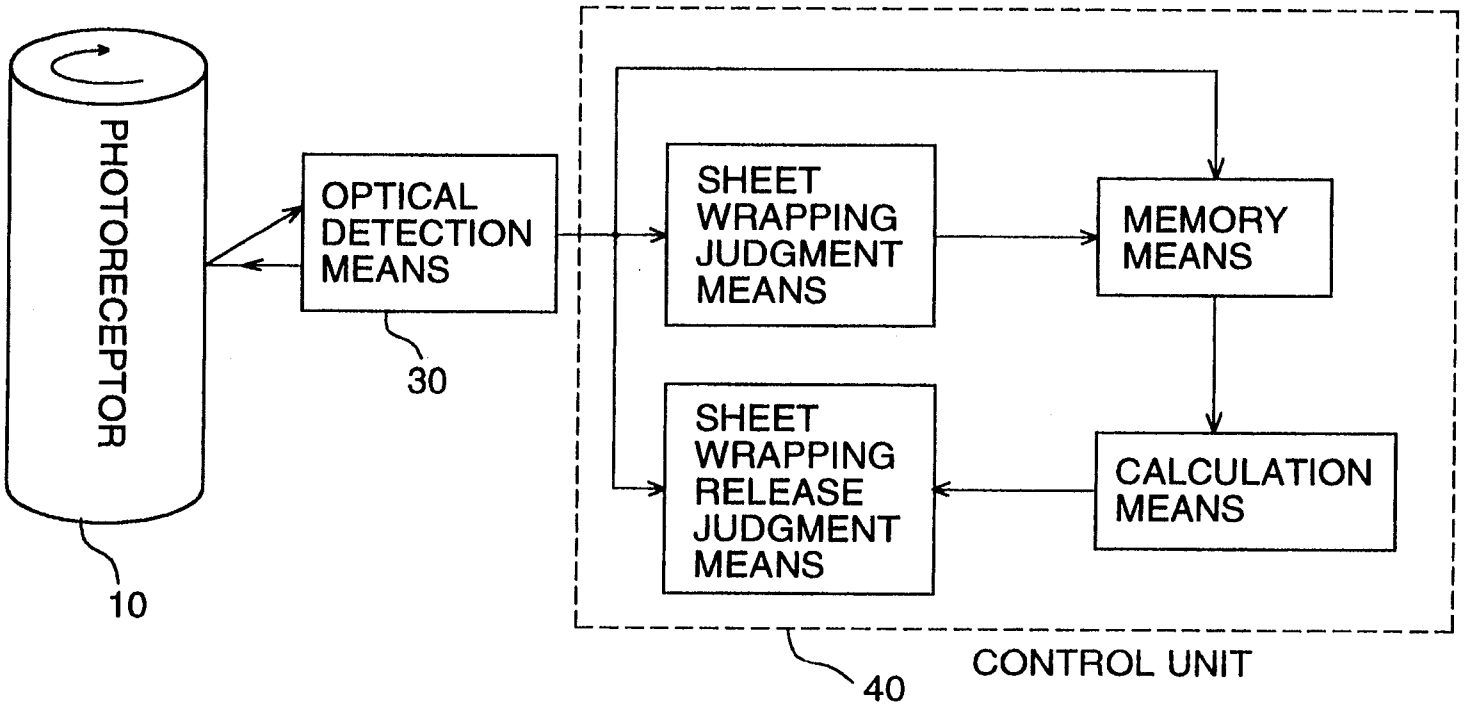
FIG. 1 is a block diagram showing an overall arrangement of the sheet wrapping detection apparatus of the present invention.
Figure 2:
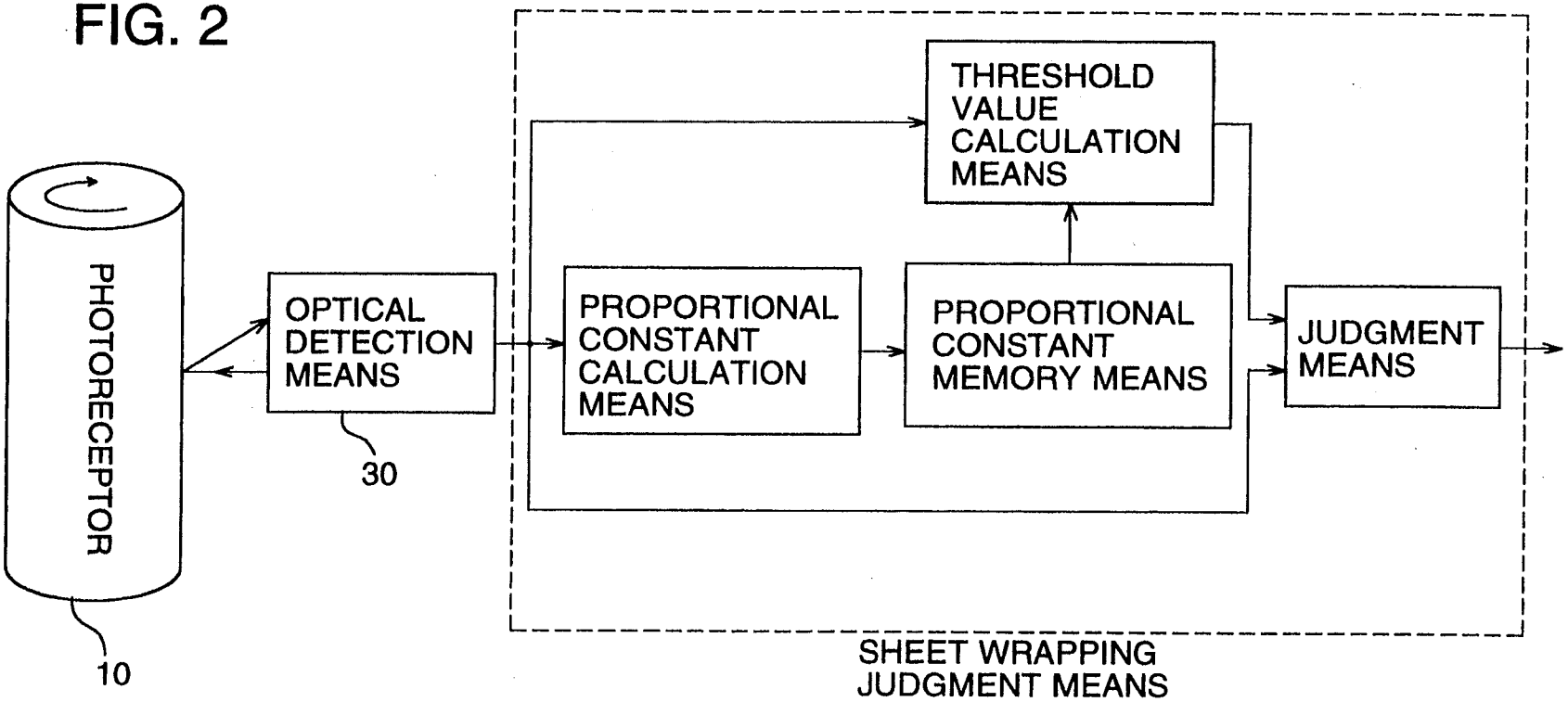
FIG. 2 is a block diagram showing a partial arrangement of the sheet wrapping detection apparatus of the present invention.
Figure 3:
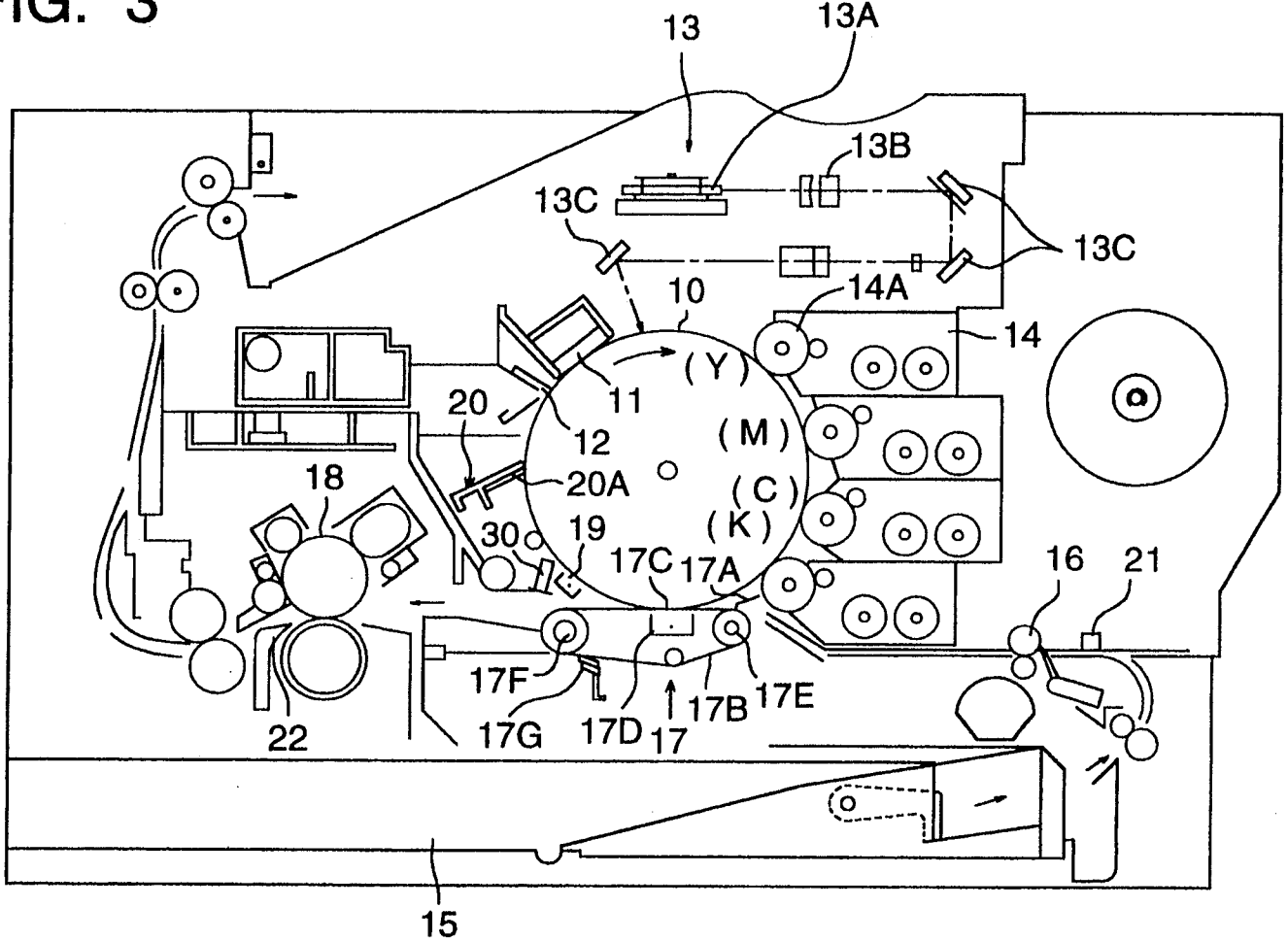
FIG. 3 is a sectional view of an image forming apparatus to which an example of the sheet wrapping detection apparatus of the present invention is applied.

FIG. 3 shows an overall arrangement of a color image forming apparatus to which an example of the sheet wrapping detection apparatus of the present invention is applied.

In FIG. 3, numeral 10 is a photoreceptor drum, the surface of which is coated with an OPC photosensitive layer. The photoreceptor drum 10 is electrically grounded and rotated clockwise in the drawing. Numeral 11 is a scorotron charger. The scorotron charger 11 gives an electrical charge onto a circumferential surface of the photoreceptor drum 10 so that a voltage $V_H$ (−600 to −800 V) is uniformly impressed upon the circumferential surface of the photoreceptor drum 10 when a grid maintained at a voltage $V_G$ (−550 to −850 V) and a discharge wire conduct corona discharging on the photoreceptor drum surface. Before the charging operation conducted by the scorotron charger 11, in order to erase the hysteresis of the photoreceptor, the circumferential surface of the photoreceptor drum 10 is neutralized when it is exposed to light by the action of PCL12 in which light emitting diodes are used.

After the photoreceptor drum 10 has been uniformly charged, an image exposure operation is carried out by an image exposure unit 13 in accordance with an image signal. The image exposure unit 13 includes a laser diode not shown, which is used as a light emitting source. The emitted light passes through a rotating polygonal mirror 13A and an f$\theta$ lens 13B. Then the optical path of the light is curved by a reflection mirror 13C. In this way, a main scanning operation is conducted. When the photoreceptor drum 10 is rotated, a sub scanning operation is conducted, and a latent image is formed. In this example, a character portion is exposed, and a reversal latent image is formed, in which the potential of the character portion $V_L$ (−100 to 0) is lower than other portions.

In a periphery of the photoreceptor drum 10, there is provided a developing unit 14 including developer which contains toners of yellow (Y), magenta (M), cyan (C) and black (K), and carrier. At first, the first color is developed by a development sleeve 14A which includes a magnet and rotates while developer is being held on the surface of the development sleeve 14A. The developer includes: carrier particles, the cores of which are made of ferrite, and the carrier particles are coated with insulating resin; and toner particles which are mainly made of polyester, and also made of pigment corresponding to each color, charging control agent, silica, titanium oxide and the like. The thickness of a developer layer formed on the development sleeve 14A is controlled to be 300 to 600 μm by the action of a layer forming rod. In this way, the developer is conveyed to a developing region.

A gap formed between the development sleeve 14A and the photoreceptor drum 10 in the development region is maintained at 0.4 to 1.0 mm which is larger than the thickness of a developer layer. A bias voltage in which an AC bias of $V_{AC}$(1.5 to 3.0 $KV_{P-P}$) and a DC bias of $V_{DC}$ (−500 to −700 V) are superimposed, is impressed in the gap. The polarity of $V_{DC}$, that of $V_H$ and that of toner are the same. Therefore, the toner, which is separated from the carrier by the action of $V_{AC}$, is not deposited on a portion of $V_H$ which is higher than $V_{DC}$, but it is deposited on a portion of $V_{DC}$ which is lower than $V_{DC}$, so that the latent image can be visualized, that is, the latent image can be developed.

After the first color image has been developed, the formation of the second color image starts, and the photoreceptor drum surface is uniformly charged by the scorotron charger 11. Then, a latent image is formed by the image exposure unit 13 in accordance with the second color image data. Due to the action of neutralization conducted by PCL12 in the first color image formation process, the toner deposited on the first color image portion can be prevented from scattering even when the potential of other portions is sharply lowered.

All the circumferential surface of the photoreceptor drum 10 is charged and the potential is increased to $V_H$. With respect to a portion where the first color image is not formed, a latent image is formed and developed in the same manner as that of the first color. In the case where development is conducted in a portion in which the first color image has already been formed, a latent image of $V_M$, is formed by the action of shading by the first color toner and the electrical charge of toner itself. Therefore, development is conducted in accordance with the potential difference between $V_{DC}$ and $V_M'$. In the case where a latent image of $V_L$ is developed with the first color toner in a portion where the first and second color images are superimposed, the first and second colors become unbalanced. Therefore, an amount of exposure of the first color is reduced so that an intermediate potential of $V_H > V_M$, (−100 to −300 V)$> V_L$ can be provided.

Concerning the third and fourth colors, the same image formation process is carried out, and a visualized image of 4 colors is formed on the circumferential surface of the photoreceptor drum 10.

On the other hand, a recording sheet P is fed from a sheet feed cassette 15. The recording sheet P is conveyed to a transfer region by a transfer unit 17, and the multicolor image formed on the circumferential surface of the photoreceptor drum 10 is entirely transferred onto the recording sheet P. That is, the recording sheet P advances between a conductive brush 17A and a transfer belt 17B, and an electrical charge, is injected onto the recording sheet P by the conductive brush 17A, so that an attraction force is generated between the recording paper P and the transfer belt 17B. After that, the recording paper P advances to a nip portion (transfer region) 17C formed between the photoreceptor drum 10 and the transfer belt 17B. A transfer electric field is given by a corona discharger 17D provided behind the transfer belt 17B, or by a bias roller. By the action of the transfer electric field, the multicolor image is transferred onto the recording paper P.

After that, the recording sheet P is separated from the photoreceptor drum 10. Then, the recording sheet P is neutralized by the action of AC corona discharge in which a holding roller 17F of the transfer belt 17B on the downstream side is used as an opposed electrode. Alternatively, the recording sheet P is separated from the transfer belt 17B while it is subjected to DC corona discharge. Numeral 17G is a cleaning blade which removes the toner deposited on the transfer belt 17B. The transfer belt 17B of the transfer unit 17 is separated from the photoreceptor drum 10 surface while it is pivotally mounted on a shaft of the holding roller 17F on the downstream side.

After the multicolor image has been transferred onto the recording sheet P by the transfer unit 17, the recording sheet P is conveyed to a fixing unit 18 composed of two press rollers, wherein at least one of them is provided with a heater. When the recording sheet P is heated and pressed by the press rollers, the toner deposited on the recording sheet P is fused and fixed onto the surface of the recording sheet P. Then, the recording sheet P is discharged outside the apparatus.

The residual toner on the circumferential surface of the photoreceptor drum 10 is neutralized after transfer by a neutralizer 19 to which an AC corona discharger is applied. Then the residual toner is conveyed to a cleaning unit 20 and scraped off by a cleaning blade 20A made of rubber, into the cleaning unit 20, wherein the cleaning blade 20A comes into contact with the photoreceptor drum surface. The scraped toner is discharged by a screw conveyer and stored in a collection box. In this connection, it is possible that the neutralizer 19 conducts a neutralizing operation on the recording sheet P depending on the arrangement of units. After the residual toner has been removed from the photoreceptor drum 10 by the cleaning unit 20, the circumferential surface of the photoreceptor drum 10 is exposed to light by PCL12. Then the circumferential surface of the photoreceptor drum 10 is uniformly charged by the scorotron charger 11 being ready for the next image formation cycle. During the formation of a multicolor image, the cleaning blade 20A is separated from the photoreceptor drum surface, and the AC neutralization of the neutralizer 19 is maintained in an off-condition.

Figure 7:
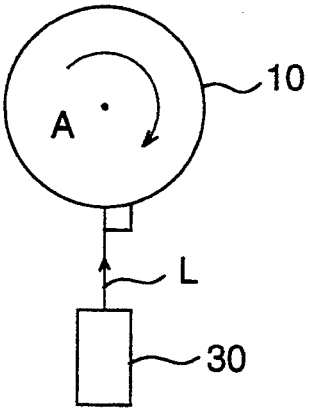
FIG. 7 is a left side view showing the positional relation between the photosensor and the photoreceptor drum illustrated in FIG. 6.

In this case, immediately after the neutralizer 19, a photosensor 30 is disposed, which is an optical detection means for sheet wrapping detection and sheet wrapping release confirmation. The photosensor 30 is constructed in the same manner as that of the conventional one shown in FIG. 7. The construction will be described as follows. A beam of light emitted from a light emitting diode is perpendicularly incident on the toner image formation surface of the photoreceptor drum 10, and the reflected light is received by a phototransistor at a predetermined angle $\theta$. By the photoreception level, the occurrence of sheet wrapping can be detected during a printing operation, and further the release of sheet wrapping can be detected after the detection of sheet wrapping.

A sheet feed sensor 21 is provided in a conveyance passage of the sheet feed mechanism 16. Accordingly, whether or not the recording sheet P has been conveyed can be detected. A sheet discharge sensor 22 is provided on the downstream side of the fixing unit 18. Therefore, whether or not the recording sheet P has been discharged can be detected.

Next, the sheet wrapping detection apparatus, which is the feature of the present invention, will be explained in detail as follows.

Figure 4:
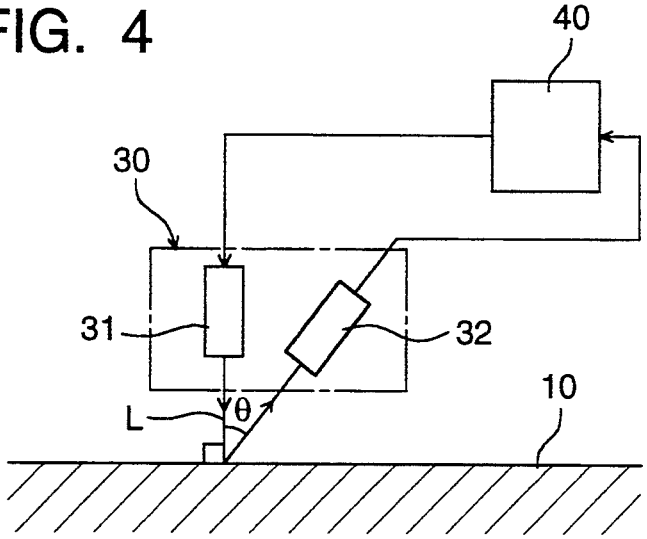
FIG. 4 is a schematic illustration for explaining the principle of measurement of photoreceptor surface level values, wherein the measurement is conducted by a photosensor.
Figure 8:
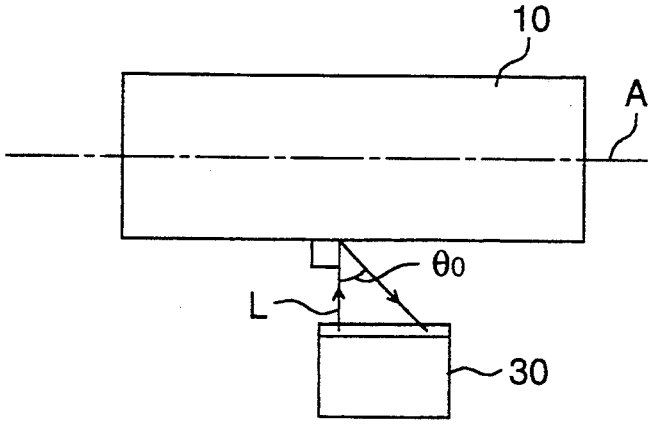
FIG. 8 is a front view showing a positional relation between a photosensor and a photoreceptor drum in a sheet wrapping detection apparatus of an example of the present invention.

Each component of the sheet wrapping detection apparatus of this example is approximately the same as that of the conventional one shown in FIG. 4, and only the arrangement of the photosensor 30 is different. Therefore, the arrangement of the photosensor 30 will be explained here. In this example, a light emitting diode 31 as a light emitting element and a phototransistor 32 as a light receiving element are arranged in the photosensor 30 in the same manner as that of the conventional one although they are not illustrated in the drawing. The photosensor 30 of this example is arranged in such a manner that a beam of light emitted from the light emitting diode 31 is irradiated on the surface of the photoreceptor drum 10 as shown in FIGS. 8 and 9.

Figure 9:
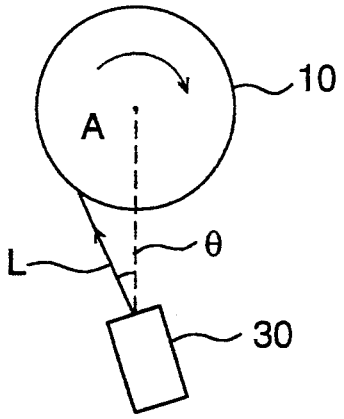
FIG. 9 is a left side view showing the positional relation between the photosensor and the photoreceptor drum illustrated in FIG. 8.

As illustrated in FIG. 9, in this example, the photosensor 30 is arranged in the following manner:

That is, in the photosensor 30, the light emitting diode 31 and the phototransistor 32 are arranged in the axial direction of the photoreceptor drum 10 in the same manner as that of the conventional example. A beam of irradiating light L is emitted from the light emitting diode 31 on a surface perpendicular to the axis A of the photoreceptor drum. In this case, the beam of light is not emitted in a direction in which the beam crosses the axis A, that is, the beam of light is not emitted in a direction perpendicular to the surface of the photoreceptor drum 10, but the beam of light is inclined by a predetermined angle $\theta$ so that the beam of light can not cross the axis A of the photoreceptor drum.

In the aforesaid arrangement, minute scratches are caused in the circumferential direction on the surface of the photoreceptor drum 10 when the photoreceptor drum 10 is cleaned by a cleaning blade. Therefore, when a beam of light is irradiated on the surface of the photoreceptor drum 10, the beam of light is irregularly reflected, and an amount of irregularly reflected light in a longitudinal direction of the drum, that is, in a direction along the axis A, is larger than that in a circumferential direction. Accordingly, as compared with a conventional case in which the beam of light L emitted from the light emitting diode 31 is perpendicular to the surface of the photoreceptor drum 10, an amount of light received by the phototransistor 32 disposed along the axis A of the photoreceptor drum 10 becomes small in a case in which the beam of light L emitted from the light emitting diode 3 is inclined with respect to the surface of the photoreceptor drum 10 as shown in FIG. 9.

On the other hand, in the case of a recording sheet P, the levels of irregular reflection become approximately the same in all directions. Accordingly, an amount of light received by the phototransistor 32 becomes approximately the same irrespective of the irradiating direction of the light emitting diode 31.

Accordingly, the photoreception level of the light reflected on the recording sheet P is hardly changed. On the other hand, the photoreception level of the light reflected on the photoreceptor drum 10 surface is greatly lowered, so that a difference between both levels can be increased.

Figure 10:
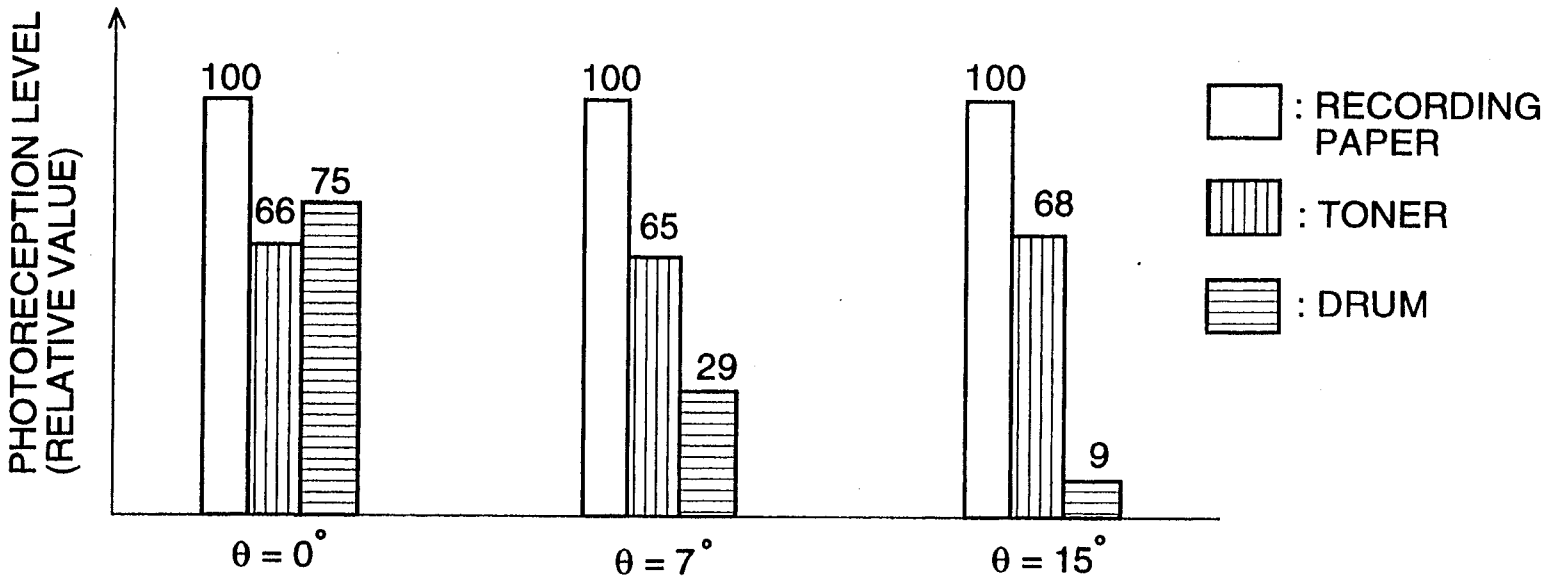
FIG. 10 is a diagram showing a relation between a photoreception level and an irradiation angle $\theta$ with respect to a recording sheet, toner and a photoreceptor drum in the example described above.

FIG. 10 is a diagram showing a relation between the irradiating angle $\theta$ of the irradiating light L of the photosensor 30 with respect to the photoreceptor drum 10 surface, and the photoreception level.

This diagram shows a relation between the irradiating angle $\theta$ with respect to the photoreceptor drum surface and the photoreception level in the following three cases. They are a case in which the irradiating light L is reflected on a recording sheet P, a case in which the irradiating light L is reflected on a yellow toner layer solidly coated on the photoreceptor drum surface, and a case in which the irradiating light L is reflected on the photoreceptor drum surface provided with no toner. In this diagram, the photoreception level is expressed by a relative value, wherein the value of the recording sheet is set at 100.

As can be seen in the drawing, compared with a conventional case in which the beam of light L emitted from the light emitting diode is perpendicular to the surface of the photoreceptor drum 10 (inclination angle $\theta=0°$), an amount of light received by the phototransistor becomes small in a case in which the beam of light L emitted from the light emitting diode is inclined with respect to the surface of the photoreceptor drum 10 (inclination angle $\theta=7°$, inclination angle $\theta=15°$).

Figure 5:
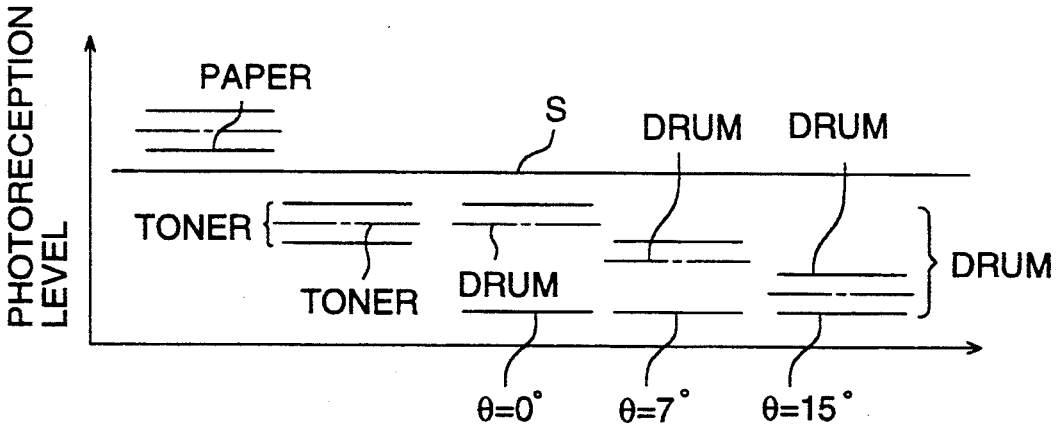
FIG. 5 is a diagram showing a relation between a threshold value and a photoreception level of each of a recording sheet, toner and photoreceptor drum.
Figure 6:
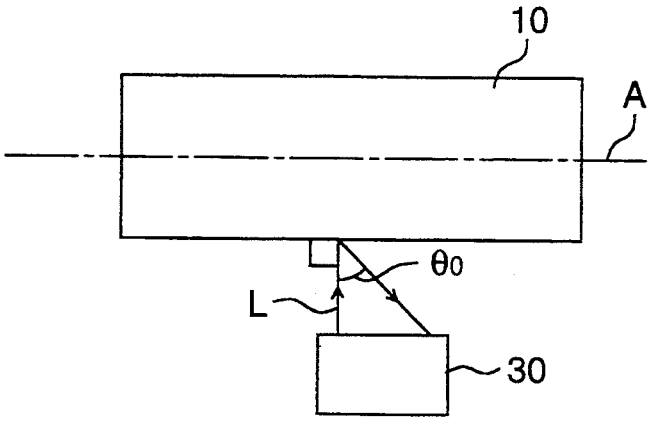
FIG. 6 is a front view showing a positional relation between a photosensor and a photoreceptor drum in a sheet wrapping detection apparatus.

As shown in FIG. 5, the deviation of the photoreception level can be reduced in different photoreceptor drums 10.

Consequently, according to the apparatus of the example, a difference between the photoreception level of the recording sheet and that of the photoreceptor drum surface can be made large compared with the conventional apparatus. Therefore, a threshold value that is set between the two photoreception levels so as to discriminate them can be very easily selected. For example, in the case where the threshold value is set at a relatively high value with respect to the photoreception level on the photoreceptor drum surface, a discrimination can be satisfactorily made between the photoreceptor drum surface and the recording sheet even if the photoreceptor drum surface is deteriorated and becomes rough so that irregular reflection is greatly caused. Therefore, the apparatus can cope with the deterioration of the photoreceptor drum 10. Consequently, the frequency of erroneous detection of sheet wrapping can be greatly reduced, and the reliability of the sheet wrapping detection apparatus can be improved.

Figure 11:
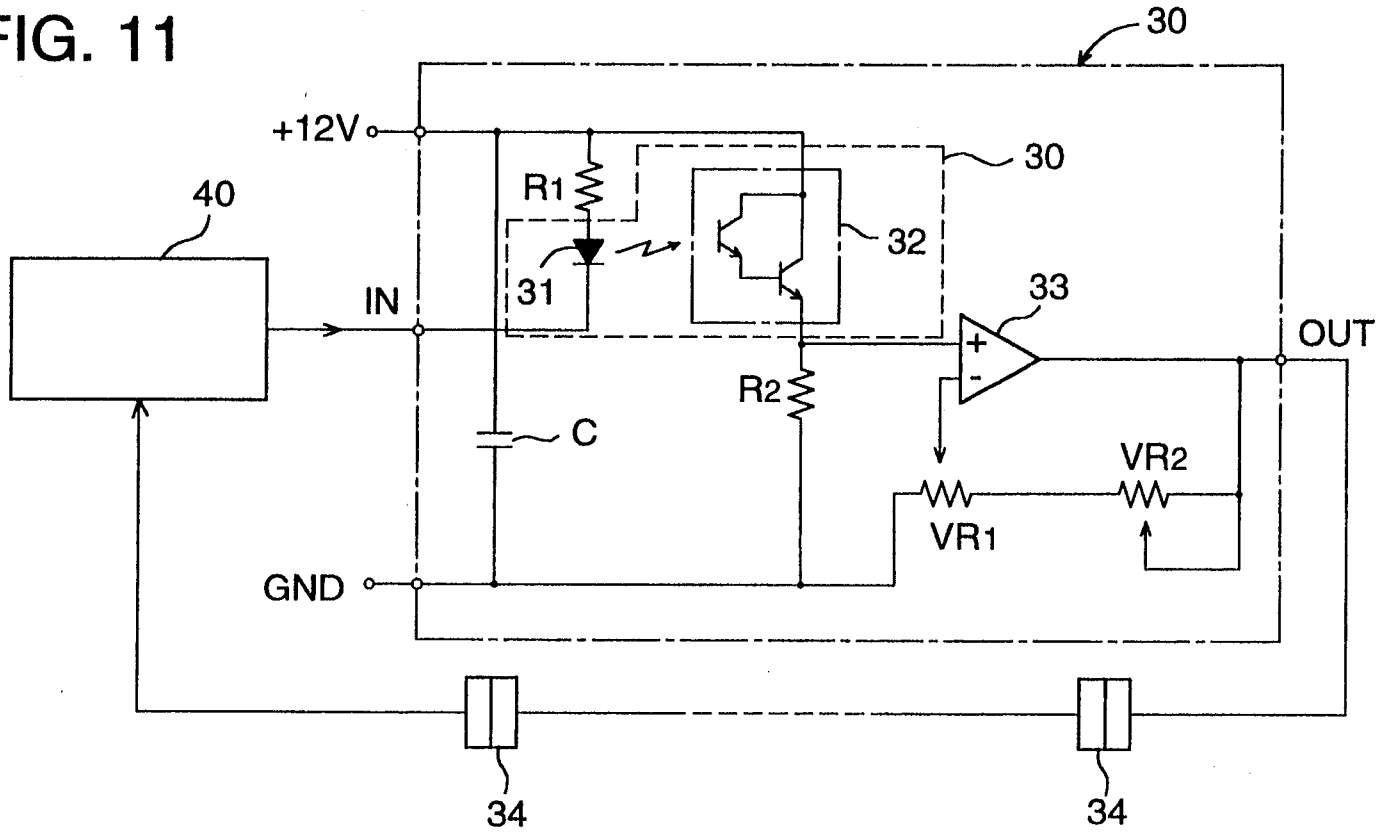
FIG. 11 is a circuit diagram showing an example of the sheet wrapping detection device of the present invention.

FIG. 11 is a circuit diagram of the sheet wrapping detection apparatus of the present example. In FIG. 11, the photosensor 30 is of the reflection type which is the same as the conventional photosensor. The photosensor 30 includes: a light emitting diode 31, which is a light emitting element to emit a beam of light in a direction perpendicular to the surface of the photoreceptor drum 10; a phototransistor 32 which is a light receiving element to receive irregularly reflected light sent from the surface of the photoreceptor drum 10; two fixed resistors $R_1$ and $R_2$; a condenser C for absorbing noise; an operational amplifier 33; and variable resistors $VR_1$ and $VR_2$ for adjusting the deviation of circuit components in the photosensor 30.

The control unit 40 is provided with a microcomputer, and outputs operational signals of low levels (L) when: the photoreceptor drum is replaced; a JAM constant is calculated in the case where the rotational number of the photoreceptor drum has reached a predetermined number (for example, 10000); a threshold value is calculated using a stored JAM constant immediately before the sheet wrapping detection; the sheet wrapping detection is conducted when the recording sheet P presumably reaches the photosensor 30; and the release of sheet wrapping is confirmed before warm-up after the sheet wrapping has been detected. When the above operational signals are outputted, the light emitting diode is activated so that the photosensor 30 is operated, and the output signal of the photosensor 30 is inputted into the control unit 40. Then, the JAM constant A is set and stored, which is a proportional constant of the photoreceptor drum 10 to the recording sheet P used for calculation of a threshold value for use in sheet wrapping detection. Further the control unit 40 conducts a threshold value calculation using the JAM constant, and also conducts a sheet wrapping detection operation. Furthermore, the control unit 40 conducts a threshold value calculation for confirmation of the sheet wrapping release according to the output of the photosensor 30 at the time of sheet wrapping stored in the sheet wrapping detection. Also, the control unit 40 carries out a confirmation operation of the release of sheet wrapping, using this threshold value.

In this connection, whereas the output terminal of the photosensor 30 and the control unit 40 are separated, they are connected by a plurality of connectors 34.

Figure 12:
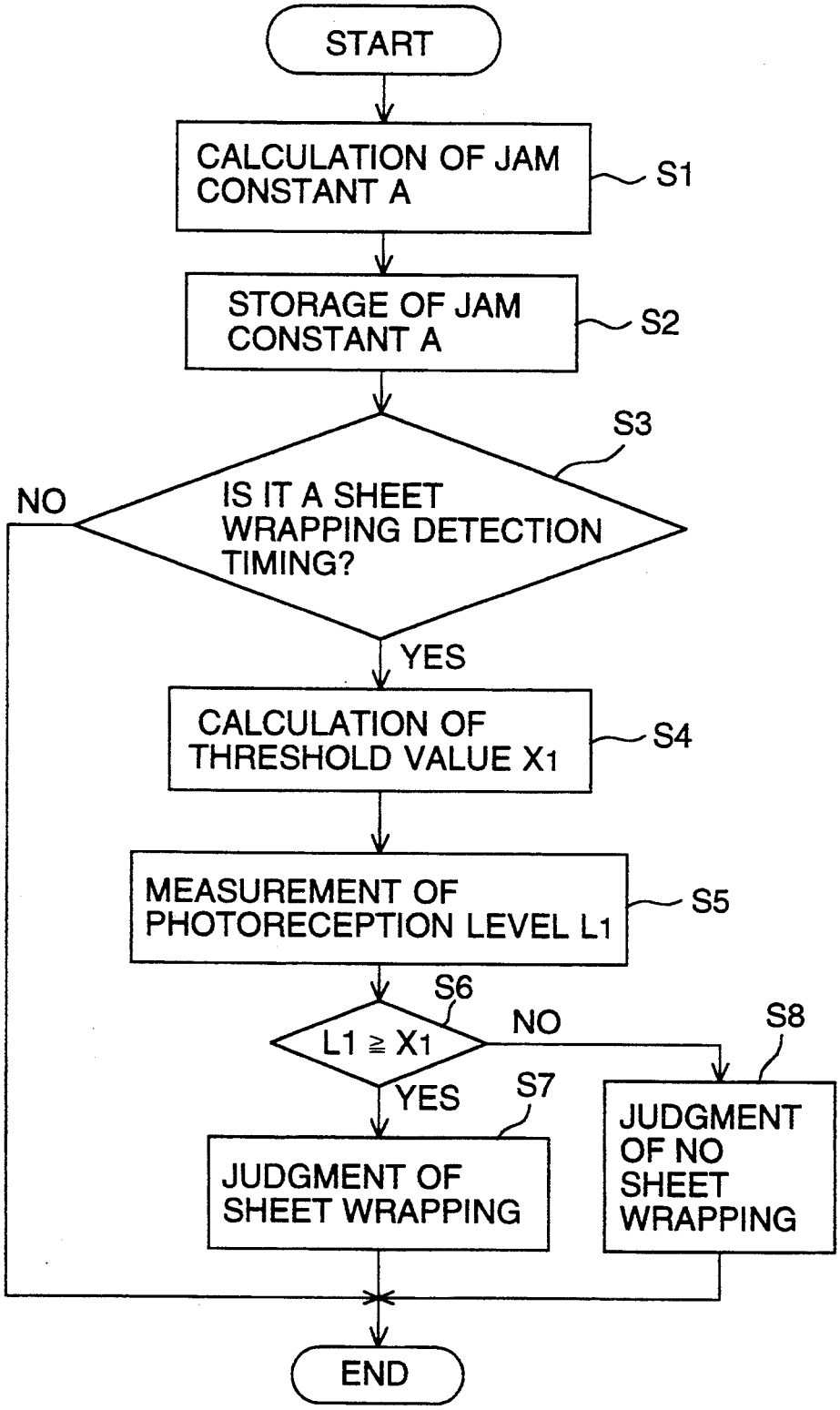
FIG. 12 is a flow chart showing the operation of the sheet wrapping detection apparatus of the aforesaid example.

With reference to a flow chart shown in FIG. 12, an outline of the operation of the sheet wrapping detection apparatus of this example will be explained as follows.

First, in step 1 (referred to as S1, hereinafter), a JAM constant A used for a threshold value calculation to detect sheet wrapping is calculated.

Figure 13:
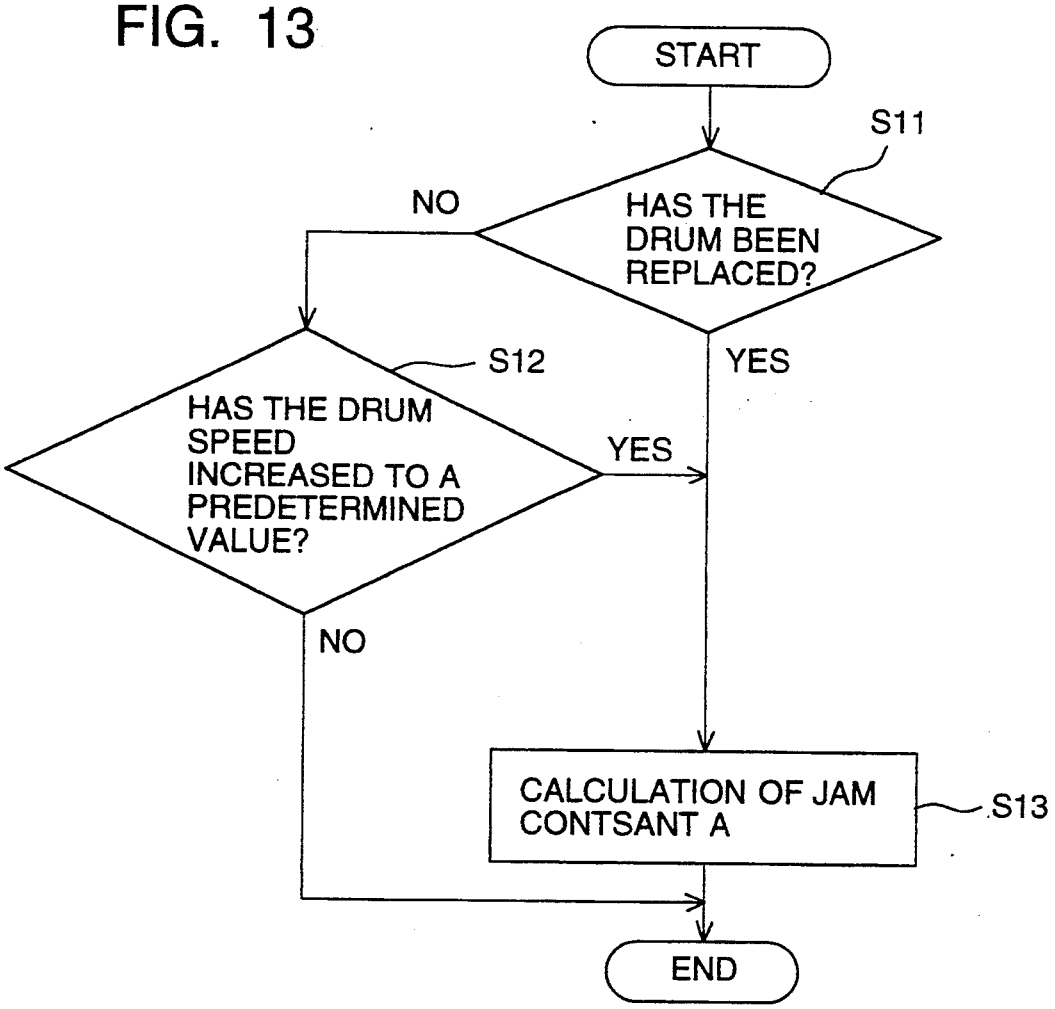
FIG. 13 is a flow chart showing the calculation of a JAM constant of the sheet wrapping detection apparatus of the aforesaid example.

As shown in a flow chart of FIG. 13, the JAM constant A is calculated in the following manner:

It is judged whether or not the photoreceptor drum 10 has been replaced (S11). In the case where the photoreceptor drum 10 has been replaced, the JAM constant A is calculated (S13). Even when the photoreceptor drum 10 has not been replaced, in the case where the printing operation has been repeated many times and the number of rotation of the photoreceptor drum 10 has reached a predetermined value (for example 10000) (S12), the JAM constant is also calculated.

The reason why the JAM constant A is renewed in accordance with the number of rotation of the photoreceptor drum 10 even when the photoreceptor drum 10 has not been replaced, will be described as follows:

When the number of printing operations is increased, a surface of the photoreceptor drum 10 becomes rough, so that a beam of light is irregularly reflected on the surface of the photoreceptor drum 10, and the photoreception level is raised. Therefore, there is a possibility that the threshold value becomes higher than the photoreception level of light sent from the recording sheet P, and that the sheet wrapping detection is not conducted.

The JAM constant A is renewed not only when the number of rotation of the photoreceptor drum 10 has reached a predetermined value, but also when the total printing hour or the number of printing operations has reached a predetermined value.

The JAM constant A is calculated in the following manner:

First, under the condition that the surface of the photoreceptor drum 10 is solidly coated with toner (for example, yellow toner), the photoreception level (the photoreception level of solidly coated toner) of a beam of light reflected on the surface of the photoreceptor drum 30 is measured by the photosensor 30. Then, the solidly coated toner is cleaned to remove all toner from the surface of the photoreceptor drum 10. Then the photoreception level (the photoreception level of the photoreceptor drum surface) of a beam of light reflected on the surface of the photoreceptor drum 30 is measured by the photosensor 30. Next, when the measured values of the photoreception level of solidly coated toner and that of the photoreceptor drum surface are respectively defined as $T_L$ and $D_L$, the JAM constant A is calculated by the following equation.

$$A = T_L \times K_l \div D_L \div K_M$$

In the above equation, $K_l$ is a proportional constant of the photoreception level of the recording sheet P to that of yellow toner, and $T_L \times K_l$ expresses an anticipated minimum photoreception level of the recording sheet P. $K_M$ is a margin, by which the threshold value is set lower than the anticipated minimum value of the recording sheet P in order to prevent the occurrence of erroneous detection.

Values of $K_l$ and $K_M$ are determined as follows:

$K_1 = 1.39$ and $K_M = 1.20$ where: a green OPC drum for use in a semiconductor laser beam is applied; yellow toner is used; a yellow light emitting diode is used for the light emitting element; the beam of light is irradiated perpendicular to the surface of an object to be detected; and the reflected light is received by an angle of about 45°. In the case where a different type photoreceptor drum, a light emitting element of a different color and a toner of a different color are used, $K_l$ and $K_M$ may be changed in accordance with them.

The JAM constant A calculated in step 1 in the aforesaid manner is stored in the memory in step 2.

Under the condition that the JAM constant is calculated and stored in the aforesaid manner, a sheet wrapping detection operation is carried out in accordance with step 3 and after that.

In step 3, whether or not it is the time to detect sheet wrapping is judged. In this example, the sheet wrapping detection operation is carried out when a normal printing operation is performed or immediately after the apparatus has been stopped because of a mechanical breakdown that can not be recovered by an operator or immediately after the apparatus has been stopped because of the occurrence of sheet jam. In either condition, it is judged to be YES in step 3, and the program advances to step 4.

In step 4, the threshold value is calculated in the following manner.

When a normal operation is carried out or immediately after the apparatus has been stopped because of a mechanical breakdown that can not be recovered by an operator or immediately after the apparatus has been stopped because of the occurrence of sheet jam, the photoreception level of the photoreceptor drum surface is measured right before a printing operation is started, and the measured value is multiplied by the JAM constant A stored in the memory. In this way, the threshold value $X_1$ is calculated. After the threshold value $X_1$ has been calculated in the aforesaid manner, the program advances to step 5.

In step 5, in order to detect the occurrence of sheet wrapping, a beam of light emitted from the photosensor 30 is irradiated on the recording sheet P in an anticipated timed relation with the recording sheet P which will arrives at a position of the photosensor 30, and the photoreception level $L_1$ is measured at that time.

In step 6, the photoreception level $L_1$ measured in step 5 and the threshold value $X_1$ calculated in step 4 are compared. In the case of $L_1 \geqq X_1$, the program advances to step 7, and it is judged that sheet wrapping has occurred, and an output of sheet wrapping is generated. In the case of $L_1 < X_1$, the program advances to step 8, and it is judged that sheet wrapping has not occurred, and an output of no sheet wrapping is generated.

In a continuous printing operation, the temperature is gradually raised as the printing operation continues. Therefore, the aforesaid calculation of the threshold value $X_1$ is conducted for each sheet of print.

Figure 14:
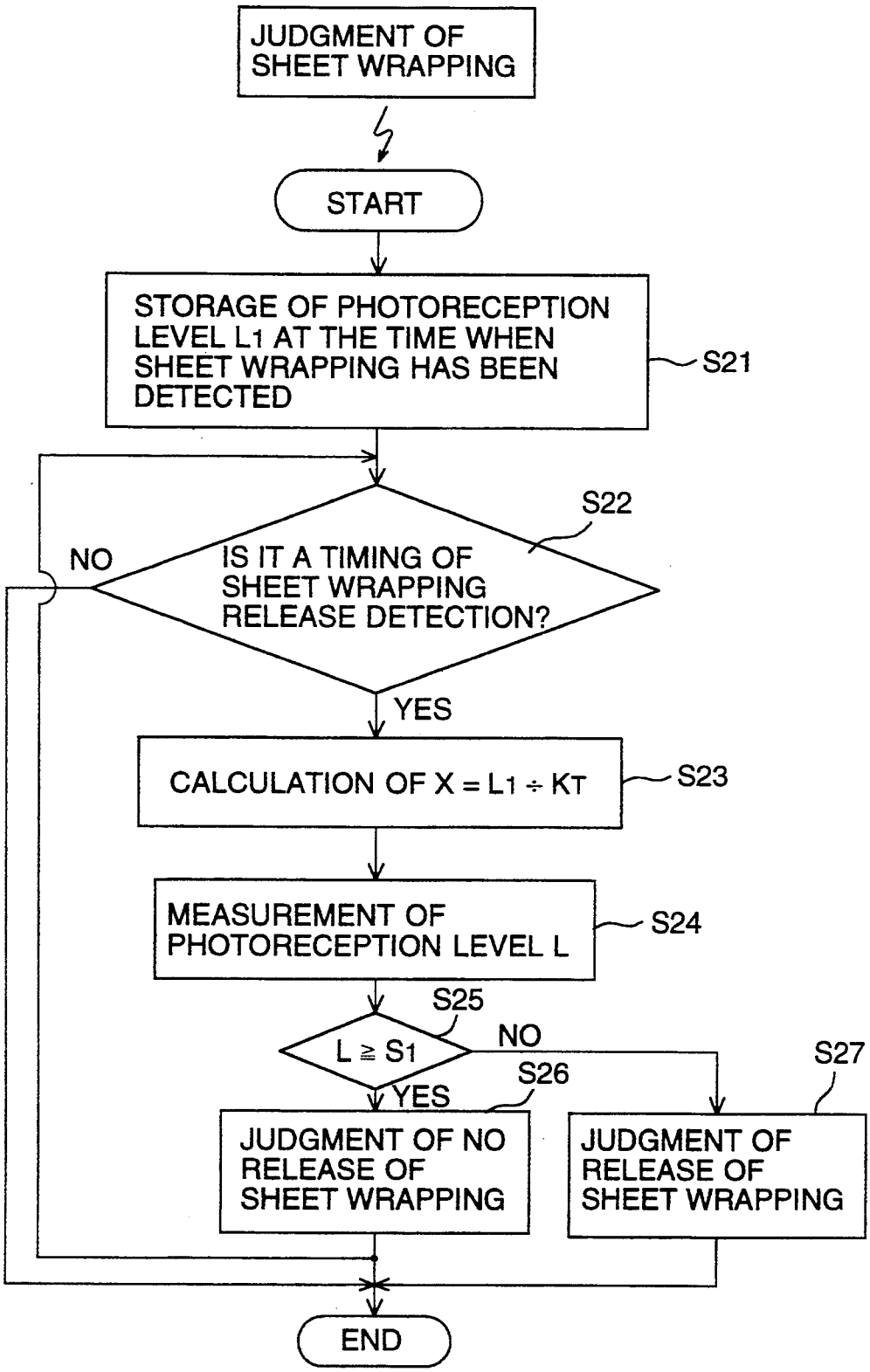
FIG. 14 is a flow chart showing the operation of confirmation of the release of sheet wrapping in the sheet wrapping detection apparatus of the aforesaid example.

Next, with reference to a flow chart shown in FIG. 14, the aforesaid sheet wrapping release confirmation operation will be explained as follows.

In the case where the occurrence of sheet wrapping has been judged in a sheet wrapping detection operation, a confirmation operation of the release of sheet wrapping, which is a feature of the present invention, is carried out before the start of warm-up, and after the release of sheet wrapping has been confirmed, the printing operation can be restarted.

The aforesaid sheet wrapping release confirmation routine is carried out when the occurrence of sheet wrapping has been judged in the sheet wrapping detection operation.

When the occurrence of sheet wrapping is judged, in step 21, the photoreception level $L_1$ of the photosensor 30 is stored in the memory at that time.

In step 22, it is judged whether or not it is a sheet wrapping release detection time. In this example, the sheet wrapping confirmation operation is carried out before the start of warm-up (before the power source is turned on) and when the sheet wrapping release has not been confirmed yet. When it is judged to be YES here, the program advances to step 23.

In step 23, the threshold value $X_2$ for use in sheet wrapping release confirmation is calculated.

In the same manner as that of the aforesaid sheet wrapping judgment operation, in the sheet wrapping release confirmation operation, a beam of light is irradiated onto the surface of the photoreceptor drum 10 by the photosensor 30, and the photoreception level is measured. However, in this case, the release of sheet wrapping has not been confirmed yet. Therefore, it can not be judged whether the measured value has been provided by the recording sheet P or by the photoreceptor drum 10 surface. Accordingly, in the calculation of the threshold value $X_2$, the threshold value $X_2$ is determined in accordance with the photoreception level $L_1$ of the photosensor 30 in the case where the sheet wrapping detection has been judged. That is, the stored photoreception level $L_1$ is divided by the temperature compensation coefficient $K_T$ previously found in experiments. Through the aforesaid temperature compensation, the threshold value $X_2$ is found (photoreception level value ÷ temperature compensation coefficient). The temperature compensation is conducted to avoid erroneous detection caused by temperature deviations. That is, when a warm-up operation is started after the previous sheet wrapping, the surface temperatures of the photosensor 30 and the photoreceptor drum 10 surface are lowered as compared with the temperatures in the case where the previous sheet wrapping occurred. Therefore, a reference temperature is set corresponding to a condition in which the apparatus is not operated at all. Then, the previous photoreception level $L_1$ is converted into a value in the case of the aforesaid reference temperature. At the completion of the calculation of the threshold value $X_2$, the program advances to step 24.

In step 24, a beam of light is irradiated on the recording sheet P by the photosensor 30 with a timed relation to the recording sheet P which is anticipated to arrive at a position of the photosensor 30, and the photoreception level L is measured at that time.

In step 25, the photoreception level L measured in step 24 and the threshold value $X_2$ are compared. In the case of $L \geqq X_2$, the program advances to step 26, and the judgment output of non-release of sheet wrapping is generated. In the case of $L < S$, the program advances to step 27, and the judgment output of release of sheet wrapping is generated. In this connection, in the case where the judgment output of non-release of sheet wrapping is generated, the program returns to step 22, and the confirmation operation of release of sheet wrapping is carried out again. In this case, the calculation of the threshold value $X_2$ may be omitted.

As described above, the threshold value used when the release of sheet wrapping is confirmed, is determined in accordance with the photoreception level of the photosensor 30 at the sheet wrapping detection conducted immediately before the confirmation operation. Accordingly, it is sufficient to conduct at least the correction of temperature variation irrespective of the deviation of individual photosensors 30 and also irrespective of the variation of output of the photosensor 30 caused by stain of toner. Therefore, the threshold value $X_2$ can be determined to be a value close to the detection level of a recording sheet. As a result, the occurrence of erroneous detection of sheet wrapping release can be greatly reduced, and the reliability can be improved.

In the sheet wrapping detection apparatus of this example, the threshold value in the case of sheet wrapping detection is variably determined in the following manner:

Consideration is given to a proportional relation in the light reflection levels of the recording sheet P, photoreceptor drum 10 and toner, and this proportional relation is approximately constant for each apparatus, and is not affected the change of temperature. In accordance with the proportional relation between toner and the recording sheet, the relation between the recording sheet and the photoreceptor drum is determined to be the JAM constant A. Using this JAM constant A, the threshold value is variably determined.

Therefore, even when the photoreception levels of the photoreceptor drum 10 surface and the recording sheet are changed due to the change in temperature and the stain of the photosensor 30, the threshold value is appropriately changed while the aforesaid fluctuation of photoreception level is anticipated. Accordingly, the occurrence of erroneous detection can be avoided in a normal sheet wrapping detection operation. As a result, the reliability of the sheet wrapping detection apparatus can be improved.

In the variable threshold value type of sheet wrapping detection apparatus described above, there is a possibility that sheet wrapping detection is not conducted or erroneous sheet wrapping detection is conducted in the case where an abnormality except for sheet wrapping occurs such as an abnormality of the photoreceptor drum, an abnormality of the photosensor, and an abnormality of the occurrence of sheet jam. In order to solve the above problems, the following measures are provided.

In the case where the photoreceptor drum 10 has not been appropriately cleaned or the photoreceptor drum 10 has been damaged, the surface level of the photoreceptor drum 10 can not be correctly measured, and the threshold value becomes abnormal. Therefore, normal sheet wrapping detection can not be conducted.

Therefore, when the surface level value of the photoreceptor drum 10 is measured, the measurement is conducted a plurality of times (for example, 3 times), that is, the surface level is measured at different points on the photoreceptor drum 10 surface. In the case where the deviations of all measured values from the previously measured level values exceed a predetermined range, it is judged that the drum surface values are abnormal, and the threshold value is set at a predetermined fixed threshold value. After the photoreceptor drum has been replaced or repaired by a serviceman, the sheet wrapping detection is conducted using a normal variable threshold value.

In this case, the predetermined value of the deviation from the previously measured level value is set in a range of ±10%. However, in the case where a certain period of time has passed after a continuous printing operation, the temperature is lowered, so that the value is set at ±40% of the previously measured value only in the first printing operation.

Next, in the case where the power supply has been turned off in the middle of printing, the recording sheet P is left in the apparatus, and it is not detected by any of the sensors such as a sheet feed sensor and a sheet discharge sensor. In the case of abnormality described above, the occurrence of abnormality can be detected in such a manner that a non-volatile memory stores that the recording sheet P is left in the apparatus between the sheet feed sensor and the sheet discharge sensor. In the case of the occurrence of the aforesaid abnormality, a threshold value is provided when the previous threshold value is corrected by a predetermined correction value. Using the threshold value, the residual sheet recovery function is activated, that is, a sheet wrapping detection operation is carried out while the photoreceptor drum is automatically rotated for discharging the residual recording sheet. As a result of the foregoing, even when a recording sheet wraps around the photoreceptor drum during an operation of the residual sheet recovery function, the sheet wrapping can be positively detected.

Next, in the case where a connector connecting the control unit 40 and the photosensor 30 is imperfectly contacted, or in the case where the connector is mistakenly attached, the occurrence of abnormality can be detected when the photosensor output is always checked. That is, the following cases are judged to be the occurrence of abnormality: a case in which a sensor output value is not more than a predetermined value when the light emitting diode 31 is emitted; and a case in which the sensor output value is not less than the predetermined value when the light emitting diode 31 is not emitted. In this connection, while the light emitting diode is not emitted, the sensor output value is checked before or after the emission of the light emitting diode each time the light emitting diode is emitted. In the occurrence of the aforesaid abnormality, the sheet wrapping detection operation is stopped.

In the case where the photoreceptor drum can not be solidly coated with toner for carrying out a JAM constant calculation, or in the case where the reflection factor of the photoreceptor drum becomes abnormal, a normal threshold value can not be provided, which causes an erroneous detection.

Therefore, it is checked whether or not the calculated JAM constant A is in a predetermined range. In the case where the constant A is out of the predetermined range, it is judged that the JAM constant is abnormal. When the aforesaid abnormality is judged, the occurrence of an error is displayed, and the apparatus is stopped.

As described above, according to the present invention, a beam of light sent from the optical detection means diagonally irradiates the photoreceptor drum on a surface perpendicular to the drum axis so that the beam of light can not cross the drum axis. Therefore, a difference between the light receiving level of a recording sheet and that of the drum surface can be made large, so that a threshold value can be easily selected and the deviation of the light receiving level between individual drums can be reduced. Accordingly, the frequency of occurrence of erroneous sheet wrapping detection can be greatly reduced, and the reliability of the sheet wrapping detection apparatus can be greatly improved.

When toner is used, a ratio of the reflection level of a recording sheet and that of the photoreceptor can be automatically recorded by a microcomputer. Due to the foregoing, a proportional ratio of the reflection level of the recording sheet and that of the photoreceptor is determined. By this proportional constant and the measured value of the photoreceptor surface immediately before the sheet wrapping detection operation, a threshold value for judging the sheet wrapping detection is determined. Therefore, the most appropriate threshold value for sheet wrapping detection can be variably determined in accordance with the environmental temperature and the condition of the stained sensor. Consequently, irrespective of the change in temperature and the stain of the sensor, the occurrence of sheet wrapping can be correctly judged. Accordingly, the erroneous detection of sheet wrapping can be avoided, and the reliability of the sheet wrapping detection apparatus can be greatly improved.

Further, when the sheet wrapping detection is conducted, an output value of the optical detection means is stored at that time, and a threshold value of the sheet wrapping release confirmation operation immediately after the sheet wrapping detection is determined in accordance with the stored output value. Therefore, it is not necessary to give consideration to the change in the output of the optical detection means caused by the deviation between individual optical detection means and the stain of toner. Therefore, when at least the temperature correction is conducted, it is possible to determine a threshold value close to the detection level of a recording sheet. Accordingly, the reliability of the sheet wrapping release confirmation can be improved.

In this example, the present invention is applied to a photoreceptor drum, however, it should be noted that the present invention is not limited to a specific example, and the present invention may be applied to a photoreceptor belt and other rotational photoreceptor.

Also, the sheet wrapping release confirmation mechanism of the present invention can be applied to a system in which the threshold value $X_1$ in the case of sheet wrapping detection is fixed to a predetermined value, that is, the sheet wrapping release confirmation mechanism of the present invention can be applied to a system in which the threshold value $X_1$ is not timely calculated from the JAM constant A.

What is claimed is:

1. An image forming apparatus for forming a toner image on a recording sheet, comprising:

means for forming a toner image on a photoreceptor;

said photoreceptor holding said toner image on a surface thereof;

means for transferring said toner image onto the recording sheet;

light emitting means for irradiating a light beam onto said surface of said photoreceptor;

a light receiver for detecting a reflection of said light beam from said surface of said photoreceptor, and for generating a variable detection signal according to an amount of said reflection of said light beam;

first comparing means for comparing a value of said variable detection signal with a first threshold value, and for generating a first comparison signal;

first judgment means for determining whether or not a sheet wrapping jam of said recording sheet on said photoreceptor occurs according to said first comparison signal;

a first memory for storing said value of said variable detection signal when said first judgment means determines that said sheet wrapping jam occurs;

first calculation means for calculating a second threshold value according to said value of said variable detection signal stored in said first memory;

second comparing means for comparing said value of said variable detection signal with said second threshold value, and for generating a second comparison signal; and second judgment means for determining whether or not a sheet wrapping jam of said recording sheet on said photoreceptor is solved according to said second comparison signal.

2. The apparatus of claim 1, wherein said first calculation means calculates said second threshold value by a temperature correction of said value of said variable detection signal stored in said first memory.

3. The apparatus of claim 1, further comprising:

first abnormality judgment means for inactivating said second judgment means when said value of said variable detection signal is out of a first predetermined value range.

4. The apparatus of claim 1, further comprising:

means for coating said surface of said photoreceptor with a toner;

second calculation means for calculating a first proportional constant of said value of said variable detection signal when nothing occurs on said surface to said value of said variable detection signal when said recording sheet occurs on said surface, from said value of said variable detection signal when said toner is provided on said surface, a second proportional constant of said value of said variable detection signal when said toner is coated on said surface to said value of said variable detection signal when said recording sheet occurs on said surface, and said value of said variable detection signal when nothing occurs on said surface;

a second memory for storing said first proportional constant; and third calculation means for calculating said first threshold value from said first proportional constant and said value of said variable detection signal.

5. The apparatus of claim 4, wherein said second calculation means calculates said first proportional constant every operation of said first comparing means.

6. The apparatus of claim 4, wherein said second calculating means calculates said first proportional constant every replacement of said photoreceptor.

7. The apparatus of claim 4, wherein said second calculating means calculates said first proportional constant according to an operation frequency of said photoreceptor.

8. The apparatus of claim 4, further comprising:

second abnormality judgment means for inactivating at least one of said first judgment means and said second judgment means when said first proportional constant is out of a second predetermined value range.

9. The apparatus of claim 1, wherein said light receives is located along an axis of said photoreceptor, and said light emitting means is located so that said light beam is emitted to said photoreceptor in a plane perpendicular to said axis except on a cross line to said axis.

* * * * *